US006843219B2

(12) United States Patent
Matsuda et al.

(10) Patent No.: US 6,843,219 B2
(45) Date of Patent: Jan. 18, 2005

(54) FUEL SUPPLY ARRANGEMENT FOR A MOTORCYCLE ENGINE

(75) Inventors: Takeshi Matsuda, Iwata (JP); Sakio Muroo, Iwata (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 0 days.

(21) Appl. No.: 10/630,225

(22) Filed: Jul. 30, 2003

(65) Prior Publication Data

US 2004/0079340 A1 Apr. 29, 2004

(30) Foreign Application Priority Data

Jul. 30, 2002 (JP) ..... 2002-220855

(51) Int. Cl.[7] ..... F02M 35/10
(52) U.S. Cl. ..... 123/184.21
(58) Field of Search ..... 123/65 R, 69 P, 123/71 R, 65 SP, 65 EM, 294, 184.21

(56) References Cited

U.S. PATENT DOCUMENTS 4,527,516 A * 7/1985 Foster ..... 123/27 GE
5,269,275 A 12/1993 Dahlgren
6,019,074 A 2/2000 Otome
6,142,123 A * 11/2000 Galasso et al. ..... 123/486
6,626,155 B1 * 9/2003 Ueda et al. ..... 123/509

FOREIGN PATENT DOCUMENTS

| | | |
|---|---|---|
| CN | 1265449 | 10/1989 |
| EP | 1 296 036 A2 | 3/2003 |
| JP | 04-094454 | 3/1992 |
| JP | 10-122100 | 5/1998 |
| JP | 2000-265922 | 9/2000 |
| JP | 2003-112677 | 4/2003 |

* cited by examiner

*Primary Examiner*—Bibhu Mohanty
(74) *Attorney, Agent, or Firm*—Knobbe, Martens, Olson & Bear LLP

(57) ABSTRACT

A fuel delivery system for a motorcycle including an engine having at least one combustion chamber. The fuel delivery system includes a fuel injector configured to deliver a fuel charge to an intake passage of the engine. The motorcycle further includes an air box defining an interior space, or plenum chamber. An inlet duct defines at least a portion of the intake passage and further defines an axis. The inlet duct also defines an opening to the intake passage disposed within the plenum chamber. A spray axis of the fuel injector is oriented parallel to the axis of the inlet duct and the fuel injector is supported by the air box.

17 Claims, 3 Drawing Sheets

FUEL SUPPLY ARRANGEMENT FOR A MOTORCYCLE ENGINE

RELATED APPLICATIONS

This application is related to, and claims priority from, Japanese patent application No. 2002-220855, filed Jul. 30, 2002, the entirety of which is expressly incorporated by reference herein.

BACKGROUND OF THE INVENTION

1. Field of the Invention

The present invention relates generally to a fuel delivery system for an engine, and more particularly, to a fuel injector mounting arrangement.

2. Description of the Related Art

Motorcycles are often equipped with engines employing a fuel-injection-type fuel delivery system to deliver fuel to a combustion chamber of the engine. Such a fuel delivery system, especially in high performance motorcycles, may include a fuel injector positioned adjacent an opening of an intake passage of the engine. The fuel injector is configured to deliver a fuel charge to the intake passage and may be used in combination with an additional fuel injector positioned downstream from the intake passage opening or, alternatively, positioned in direct communication with the combustion chamber. In such an arrangement, the fuel injector adjacent the intake passage opening is referred to as a "secondary" fuel injector, while the downstream fuel injector is referred to as the "primary" fuel injector. Typically, the primary fuel injector provides fuel to the combustion chamber during all running conditions of the engine and the secondary fuel injector provides supplemental fuel to the combustion chamber during selected running conditions, such as when the engine is experiencing a high load or a rapid increase in engine speed, for example.

In one prior arrangement, the secondary fuel injector is supported within an air cleaner box by a support frame. The support frame is a framework-type member that supports the secondary fuel injector from the end of an inlet duct, which defines the opening of the intake passage. That is, the support frame includes a first end connected to the inlet duct, a second end for supporting the fuel injector, and a body portion connecting together the first and second ends. The body portion of the support frame between the first and second ends is made up of a number of stays, or arms, interconnecting the first and second ends of the support frame. Specifically, in the prior arrangement, three stays are provided to interconnect the first and second ends of the support frame. Accordingly, the body portion of the support frame is partially open to permit air to enter the inlet duct and move toward the combustion chamber of the engine through the intake system, which includes a throttle body for controlling a volume of air permitted to enter the combustion chamber.

Although the inclusion of a secondary fuel injector provides a potential increase in engine performance, the support frame of the type described above has numerous disadvantages. Significantly, the stays, or arm members, that extend from the inlet duct and of the support frame to support the fuel injector interfere with a flow of air entering the intake passage through the inlet duct. Accordingly, the resistance to a flow of intake air into the engine is increased, which results in a reduction in the performance of the engine. Furthermore, the inlet duct, support frame, and secondary fuel injector must be disassembled in order to remove the air cleaner box and/or the throttle body, thus increasing the amount of time needed to perform certain routine maintenance procedures to the engine.

In addition, in order to accommodate the secondary fuel injector, support frame and associated components, such as a fuel rail, and also to provide a clearance space between the secondary fuel injector and the air cleaner box, the size of the air cleaner box is large. Typically, the air cleaner box is positioned below the fuel tank of the motorcycle. As a result, when the size of the air cleaner box is enlarged, the size of the fuel tank is often decreased in order to compensate, thereby reducing a mileage range of the motorcycle per tank of fuel. Furthermore, the support frame adds to the weight of the motorcycle and also increases the manufacturing cost.

SUMMARY OF THE INVENTION

One aspect of the present invention involves a fuel delivery system for a motorcycle including an engine having a combustion chamber. The fuel delivery system includes a fuel injector configured to deliver a fuel charge to an intake passage communicating with the combustion chamber. The motorcycle includes an air box defining an interior space, or plenum chamber. An inlet duct defines at least a portion of the intake passage and has an axis. The inlet duct further defines an opening into the intake passage that is disposed within the plenum chamber. A spray axis of the fuel injector is parallel to the axis of the inlet duct and the fuel injector is supported by the air box.

Another aspect of the present invention involves a motorcycle including a frame assembly and an internal combustion engine supported by the frame assembly and defining at least one combustion chamber therein. An air intake system is configured to guide air to the internal combustion engine and a fuel delivery system is configured to deliver fuel to the internal combustion engine. The air intake system comprises an air box defining a plenum chamber and an intake passage communicating with at least one combustion chamber. A portion of the intake passage further defines an axis and an opening into the intake passage that is disposed within the plenum chamber. The fuel delivery system includes a fuel injector configured to deliver a fuel charge to the intake passage. A spray axis of the fuel injector is parallel to an axis of the intake passage and the fuel injector is supported by the air box.

An additional aspect of the present invention involves a motorcycle including a frame assembly and an internal combustion engine supported by the frame assembly. The internal combustion engine defines at least one combustion chamber. An air intake system is configured to guide air to the internal combustion engine and a fuel delivery system is configured to deliver fuel to the internal combustion engine. The air intake system includes an air box defining a plenum chamber. An intake passage communicates with the at least one combustion chamber and further defines an opening within the plenum chamber. The fuel delivery system includes a fuel tank and a fuel injector. A fuel pump supplies fuel from the fuel tank to the fuel injector through a fuel delivery conduit. The fuel injector is configured to deliver a fuel charge to the intake passage and is supported by the air box. The fuel delivery conduit includes a first conduit section and a second conduit section that extend between the fuel tank and the fuel injector. The first conduit section and the second conduit section are connected to one another by a toolless coupler.

BRIEF DESCRIPTION OF THE DRAWINGS

These and other features, aspects and advantages of the present invention will now be described with reference to drawings of a preferred embodiment, which is intended to illustrate, but not to limit, the present invention. The drawings contain three figures.

DETAILED DESCRIPTION OF THE PREFERRED EMBODIMENT

Figure 1:
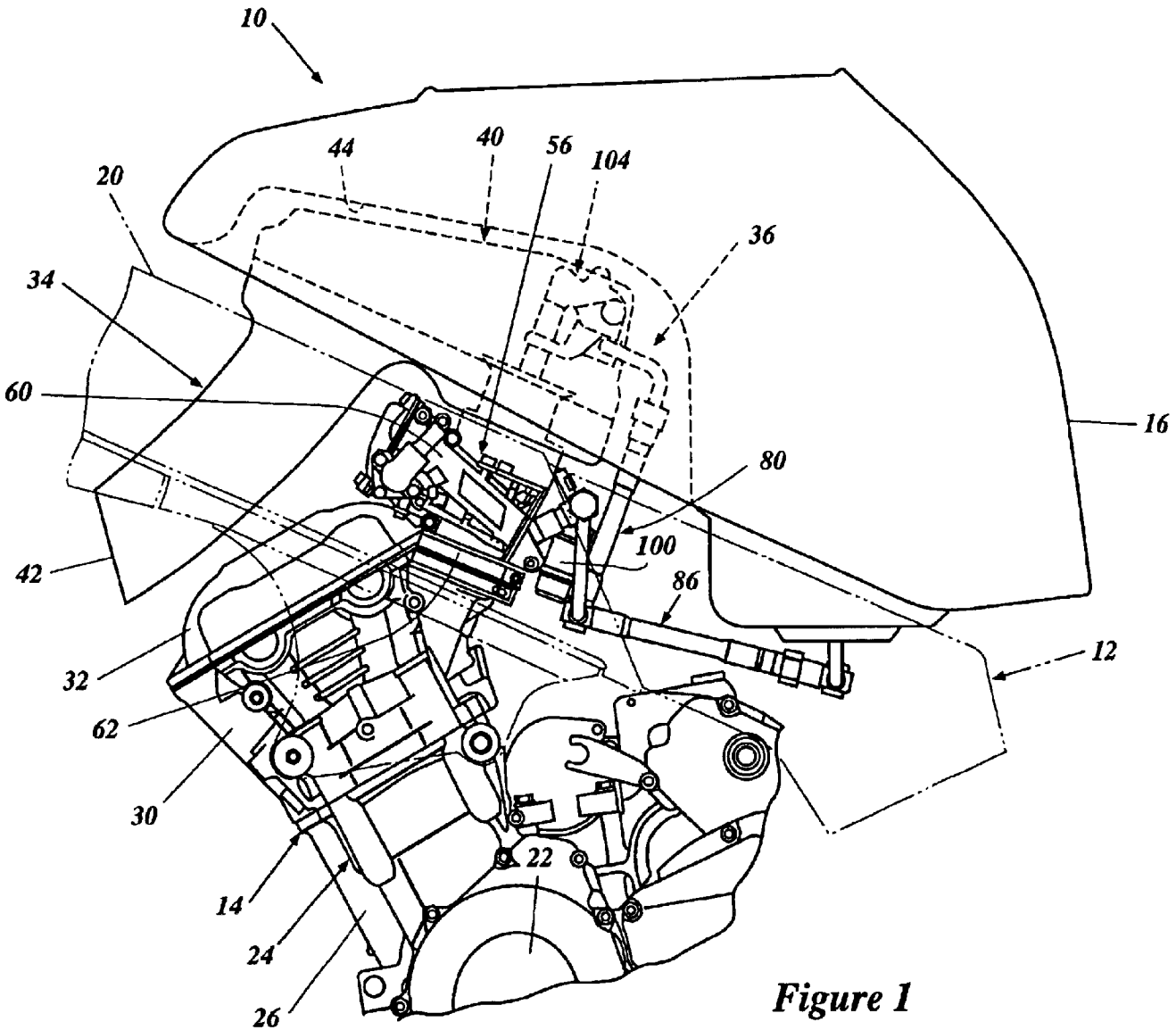
FIG. 1 is a side, elevational view of a portion of a motorcycle including a fuel delivery system configured in accordance with the preferred embodiment.
Figure 2:
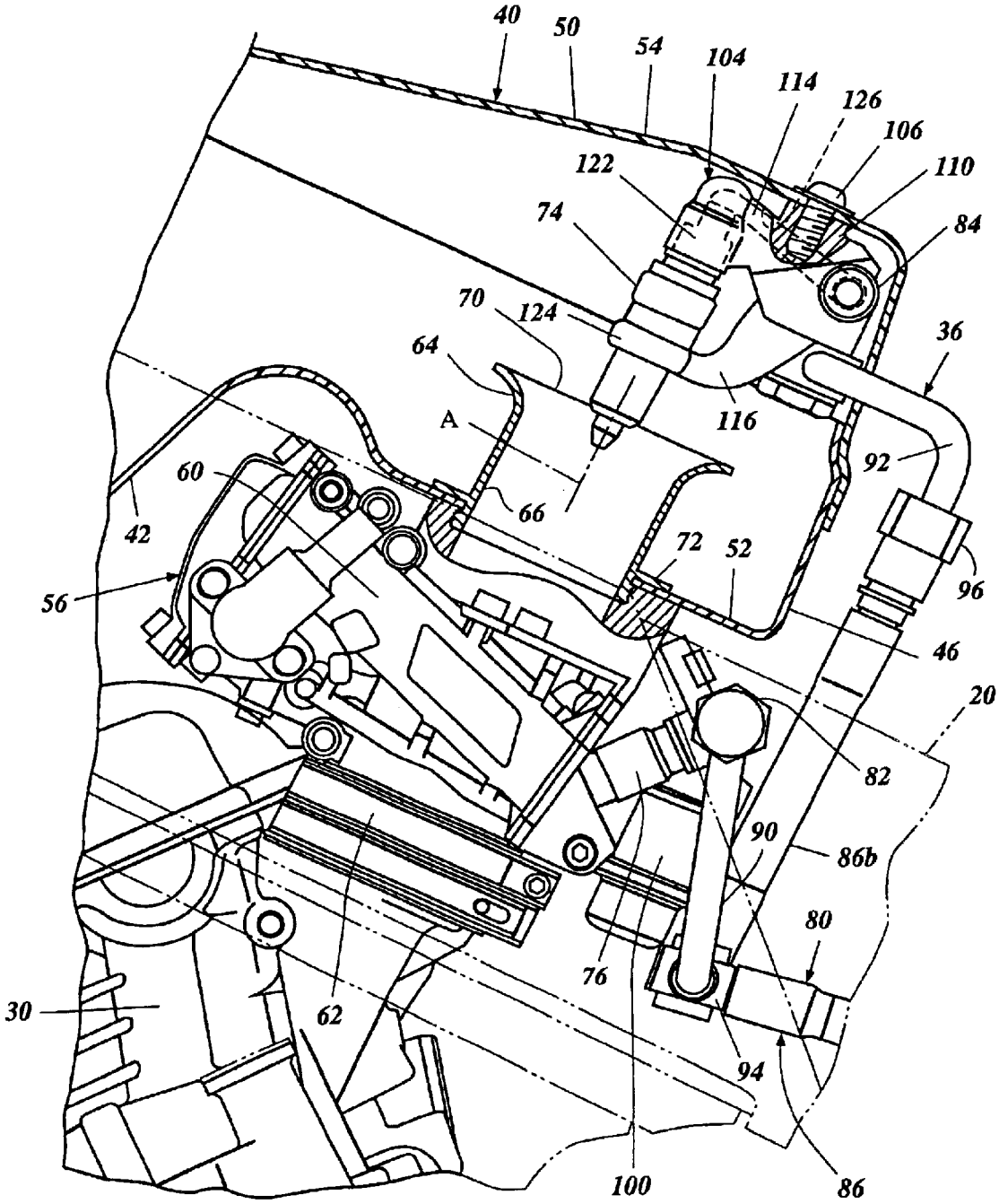
FIG. 2 is an enlarged, partial cross-sectional view of the fuel delivery system of FIG. 1.
Figure 3:
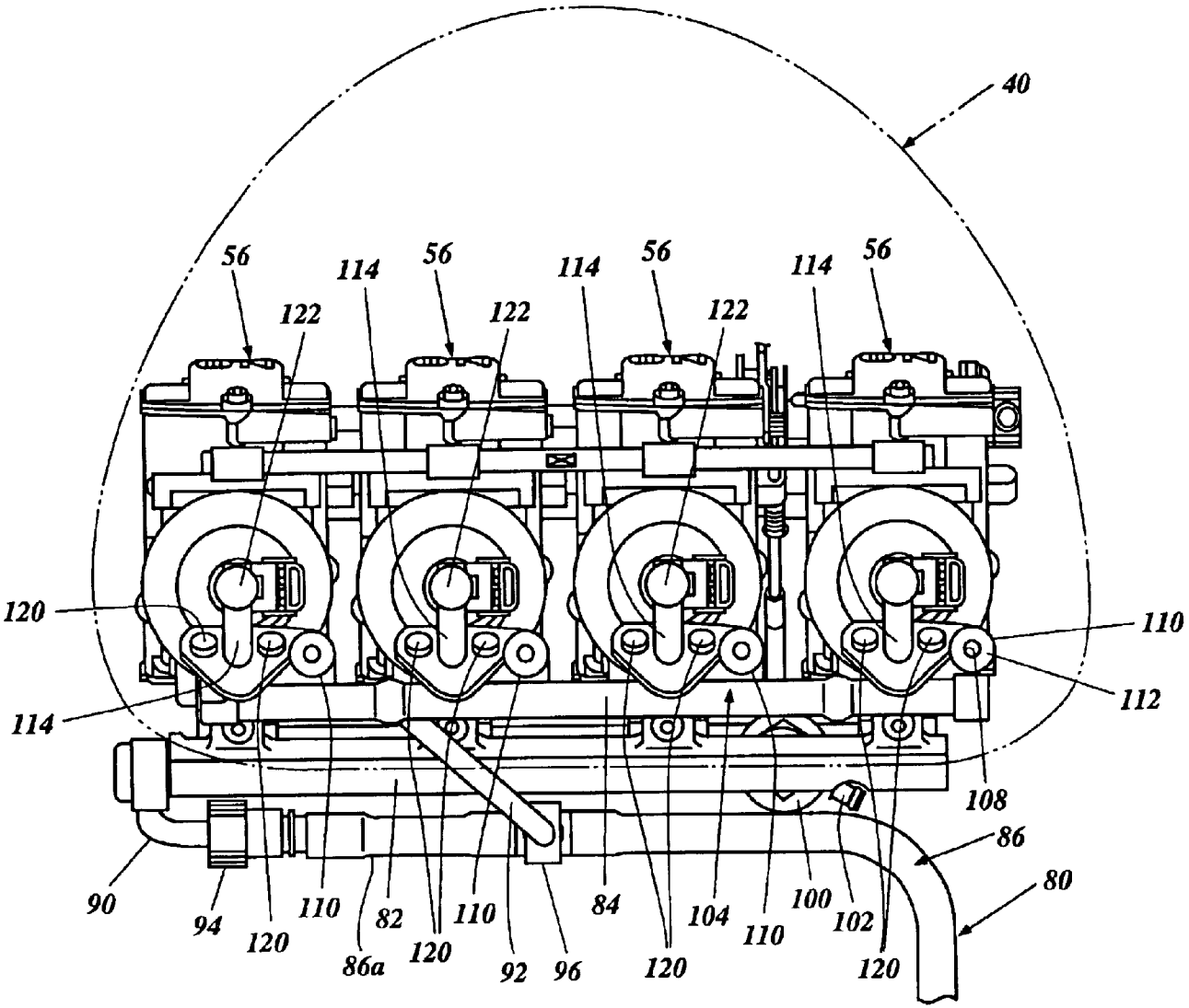
FIG. 3 is a top plan view of the fuel delivery system of FIG. 1.

FIGS. 1 through 3 illustrate a motorcycle, generally referred to by the reference numeral 10, incorporating a preferred embodiment of the present fuel delivery system. Preferably, the preferred embodiment includes a fuel injector mounting arrangement that provides for less interruption of intake air flow than prior fuel injector supports. Furthermore, such a preferred mounting arrangement provides for ease of dissassembly of the air box. In addition, preferably, the mounting arrangement does not substantially increase the size of the air box or the overall weight of the fuel delivery system. In addition, preferably, the mounting arrangement does not significantly increase manufacturing costs.

Although described in the context of use on a motorcycle 10, the present fuel delivery system may also be utilized in connection with a number of other types of vehicles, such as all terrain vehicles, snowmobiles, outboard motors and personal watercraft, for example. The motorcycle 10 and fuel delivery system are described with reference to a coordinate system where a longitudinal axis passes lengthwise through the motorcycle 10. A central, vertical plane generally bisects the motorcycle 10 and contains the longitudinal axis. A lateral plane is oriented generally horizontally, normal to the central plane. Relative heights are expressed as distances from a surface upon which the motorcycle 10 rests.

The motorcycle 10 includes a frame assembly 12, which supports an engine 14 of the motorcycle 10. In the illustrated embodiment, a fuel tank 16 is supported in a position generally above the frame 12. Although not illustrated in FIG. 1, a forward end of the frame 12 includes a head tube, which rotatably supports a front suspension assembly. A front wheel of the motorcycle 10 is supported at a lower end of the front suspension assembly. Similarly, a rear wheel is supported relative to the frame 12 by a rear suspension assembly. Other features of the motorcycle 10 not specifically illustrated in FIGS. 1–3, may be considered to be of conventional construction.

The illustrated frame assembly 12 includes a pair of frame rails 20 extending in a direction from a forward end of the motorcycle 10 toward a rearward end of the motorcycle 10 and being laterally spaced from one another to define an open area therebetween. As illustrated in FIG. 1, the frame rails 20 are canted in a downward direction when moving from a front end toward a rear end of the motorcycle 10. Preferably, the engine 14 is positioned generally below the frame rails 20, while the fuel tank 16 is positioned generally above the frame rails 20.

The engine 14 includes a crankcase 22, which houses a crankshaft (not shown) therein. A cylinder assembly 24 extends upwardly from the crankcase 22 and, preferably, is canted forward from a vertical axis. The cylinder assembly includes a cylinder body 26, a cylinder head 30 and a head cover, or valve cover 32. The cylinder body 26 defines an internal bore, which supports a piston (not shown) for reciprocation therein. The piston is connected to the crankshaft through a connecting rod (not shown). The cylinder head 30, along with the piston and the cylinder bore, define a combustion chamber of the engine 14. The cylinder head 30 and valve cover 32 define a valve chamber therebetween, which houses valves configured to selectively permit communication with the combustion chamber.

Desirably, the engine 14 includes a plurality of cylinder assemblies 24 and, preferably, the engine 14 includes four cylinder assemblies 24. Desirably, the cylinder assemblies 24 are arranged such that an axis of the cylinder bores are substantially parallel with one another and are aligned in a lateral direction. Thus, the illustrated engine 14 is a parallel (in-line) four-cylinder, four-cycle engine. The engine 14 preferably is water-cooled, however, the present fuel delivery system may also be used with air-cooled engines, as will be appreciated by one of skill in the art. In addition, the present fuel delivery system may be used with other types of engines as well, such as engines having other numbers of cylinders, or operating on other operating principles, such as a two-cycle, crankcase compression engine, for example.

The engine 14 desirably includes an exhaust system (not shown) that communicates with the combustion chambers to route exhaust gases from the engine 14 to the atmosphere. In addition, the motorcycle 10 includes an air intake system 34 to provide fresh air to the engine 14, and a fuel delivery system 36, which supplies fuel to the combustion chambers of the engine 14. The air intake system 34 and the fuel delivery system 36 preferably are positioned generally between the engine 14 and the fuel tank 16, in an open space between the frame rails 20.

The illustrated air intake system 34 includes an air box 40, which defines an interior space, or plenum chamber, therein. An elongated, air intake duct 42 communicates with the interior space of the air box 40 to permit air to enter the air box 40. The air box 40 acts as an air intake silencer to reduce noise produced by air being drawn into the combustion chambers of the engine 14. In addition, the air box 40 and air intake duct 42 may cooperate with an air filter arrangement (not shown) to filter air entering the air box 40, thus functioning as an air cleaner box. Furthermore, in some applications, a flame arrestor may be provided within the air box 40 to prevent a backfire of the engine 14 from setting fire to combustible fumes within, or near, the air box 40. As illustrated in FIG. 1, preferably, the air box 40 is at least partially housed within a recess 44 defined by an underneath surface of the fuel tank 16.

With reference to FIG. 2, the illustrated air box 40 includes a first section, or base 46, and a second section, or lid 50. The base 46 includes a bottom wall 52, an inner surface of which faces an inner surface of an upper wall 54 of the lid 50. A height of the air box 40 is defined between the bottom wall 52 and the upper wall 54. With reference to FIG. 3, preferably, a forward facing wall of the air box 40 is semi-circular in shape (in a top plan view) and a rearward facing wall is substantially linear. However, the air box 40 may have other suitable shapes, as will be appreciated by one of ordinary skill in the art.

The lid 50 preferably is removable from the base 46. In the illustrated arrangement, an upper peripheral portion of the base 46 fits securely within a lower peripheral portion of the lid 50 to removably couple the base 46 and the lid 50, thereby substantially sealing the interior space of the air box 40. However, other suitable constructions may also be used.

For example, one of the base 46 or lid 50 may define a groove, which receives a complementary rim portion of the other of the base 46 and lid 50. In addition, a separate seal member may be provided, such as an O-ring, for example, to provide a seal between the base 46 and the lid 50. Any suitable type of fastener may also be used to secure the lid 50 to the base 46 in such an arrangement.

With reference to FIGS. 1 through 3, the air intake system 34 also includes a throttle body 56 and, preferably, one throttle body 56 for each cylinder 30 of the engine 14 (i.e., four throttle bodies 56). Each throttle body 56 includes a throttle valve 60, which is configured to selectively permit a flow of air to enter an associated combustion chamber of the engine 14. Preferably, the throttle valve 60 is configured to vary a volume of air that is permitted to flow to the combustion chamber, as is well known in the art. The throttle valve 60 may be of any suitable type including a butterfly-type valve or a slide-type valve, for example. The illustrated throttle valve 60 is a slide-type throttle valve.

The throttle body 56 is connected to the associated cylinder 30 of the engine 14 by a coupler, such as a rubber sleeve and a clamp connector 62. The rubber connector 62 preferably inhibits vibrations produced by the engine 14 from being transmitted to the throttle body 56.

An inlet duct 64 is connected to the throttle body 56 and extends into the interior space of the air box 40. The cylinder 30, throttle body 56 and inlet duct 64 cooperate to define an intake passage 66, which communicates with the combustion chamber.

The illustrated inlet duct 64 preferably is a bell-mouth opening member, which defines an opening 70 of the intake passage 66 within the air box 40. Thus, a diameter of the opening 70 is larger than a diameter of the intake passage 66 defined by a downstream end of the inlet duct 64. Furthermore, the inlet duct 64 defines an axis A, which extends at least partially along the intake passage 66 from the opening 70 in a direction toward the combustion chamber of the engine 14.

In the illustrated embodiment, the downstream end of the inlet duct 64 (i.e., the end opposite the opening 70) includes external threads that mate with internal threads of the throttle body 56 to secure the inlet duct 64 to the throttle body 56. A portion of the base 46 of the air box 40 is received between a flange 72 of the inlet duct 64 and the throttle body 56 to secure the base 46 of the air box 40 to the throttle body 56. In addition, other suitable support members, or stays, may be provided to support the air box 40.

With reference to FIG. 3, preferably a throttle body 56 and inlet duct 64 assembly are provided for each of the cylinders 30 of the engine 14. Thus, preferably, a total of four throttle body 56 and inlet duct 64 assemblies are provided. Desirably, each of the four throttle body 56 and inlet duct 66 assemblies are substantially the same as described immediately above.

As described above, the fuel delivery system 36 is configured to supply fuel to the combustion chambers of the engine 14. In addition to the fuel tank 16, the fuel delivery system 36 includes a charge former, such as fuel injector 74, positioned adjacent the intake passage 66 and, more specifically, positioned adjacent the inlet duct 64. Preferably, the fuel injector 74 is positioned within the interior space of the air box 40 and is oriented such that an axis of the fuel charge emitted from the fuel injector 74 (i.e., a spray axis) is parallel to the axis A of the intake passage 66. More preferably, the spray axis of the fuel injector 74 and the intake passage 66 are substantially coaxial. In the illustrated embodiment, a longitudinal axis of the body of the fuel injector 74 coincides with the spray axis. However, in some arrangements, the axis of the fuel injector body 74, and the spray axis may be offset from one another and, in some arrangements, may be substantially perpendicular. As illustrated in FIG. 2, desirably, a nozzle end of the fuel injector 74 is positioned at least slightly within the intake passage 66. That is, the nozzle end of the fuel injector 74 passes through the opening 70 of the inlet duct 64.

In addition, the fuel delivery system 36 preferably includes an additional charge former, such as another fuel injector 76, which communicates with the intake passage 66 and is supported on the throttle body 56. Thus, a nozzle end of the fuel injector 76 is positioned downstream from the nozzle end of the fuel injector 74 in a direction of air flow passing through the intake passage 66 to the combustion chamber of the cylinder 30. In the illustrated embodiment, the fuel injector 76 is used as a primary fuel injector, while the fuel injector 74 is used as a secondary fuel injector. Desirably, the primary fuel injector 76 provides a supply of fuel to the combustion chamber during all operating conditions of the engine 14. The secondary fuel injector 74 provides a supplemental supply of fuel to the combustion chamber during selected operating conditions of the engine, such as, for example but without limitation, during high engine loads or rapid increases in engine speed.

A fuel delivery arrangement 80 supplies fuel from the fuel tank 16 to first and second fuel rails 82, 84, respectively. The first fuel rail 82 supplies fuel to each of the primary fuel injectors 76 associated with each of the cylinders 30 of the engine 14. Similarly, the fuel rail 84 supplies fuel to each of the secondary fuel injectors 74 associated with each of the throttle bodies 56. Preferably, the first fuel rail 82 is positioned outside of the air box 40 (along with the primary fuel injectors 76) and the second fuel rail 84 is positioned within the air box 40 (along with the secondary fuel injectors 74).

The fuel delivery arrangement 80 includes a main supply conduit 86, which branches into at least two portions. In the illustrated embodiment, the main supply conduit 86 branches into a horizontal portion 86A (FIG. 3) and a vertical portion 86B (FIG. 2). The horizontal portion 86A supplies fuel from the fuel tank 16 to a primary branch 90 and the vertical portion 86B supplies fuel from the fuel tank 16 to a secondary branch 92. The primary supply branch 90 and the secondary supply branch 92 deliver fuel from the main delivery conduit 86 to the first and second fuel rails 82, 84, respectively. With reference to FIG. 2, the secondary supply branch 92 in the illustrated embodiment passes through the air box 40 to access the second fuel rail 84.

In the illustrated arrangement, the horizontal portion 86A of the main supply conduit 86 is coupled to the primary branch 90 by a coupler 94 (FIG. 3). Similarly, the vertical portion 86B of the main supply conduit is connected to the secondary branch 92 by a coupler 96 (FIG. 2). Desirably, each of the couplers 94, 96 are configured to permit connection and disconnection of the main supply conduit 86 with the primary and secondary branches 90, 92, respectively, without the use of tools. Accordingly, the couplers 94, 96 are referred to herein as toolless couplers. The toolless couplers 94, 96 may be of any suitable construction as will be appreciated by one of ordinary skill in the art. For example, the couplers 94, 96 may include a base, having external threads, and a cap, having internal threads that mate with the external threads of the base. In the illustrated embodiment, the caps of the couplers 94, 96 are carried by, and are movable relative to, the primary supply branch 90 and the secondary supply branch 92, respectively. In addition, the couplers 94, 96 may include suitable seal members, such as O-rings, for example, to create a fluid-tight seal between the cap and base.

Fuel is supplied from the fuel tank 16 to the main supply conduit 86 by a fuel pump (not shown), which is positioned within the fuel tank 16 in the illustrated embodiment. A downstream end of the first fuel rail 82 communicates with a pressure regulator 100 through a conduit (not shown). The pressure regulator 100 preferably is configured to maintain the fuel within the fuel delivery system 36 at a desired pressure. With reference to FIG. 3, the pressure regulator 100 includes a fuel return port 102, which is connected to a return line (not shown) extending to the fuel tank 16. Excess fuel is returned to the fuel tank 16 through the return line. Thus, the illustrated fuel delivery system 36 is a re-circulating type system; however the pressure regulator 100 can alternatively be placed upstream of the fuel rails 82, 84 in other embodiments.

As best seen in FIG. 2, each of the secondary fuel injectors 74 preferably are secured to the air box 40 by a support structure, or bracket 104. More preferably, the secondary fuel injector 74 is secured to the upper wall 54 of the lid 50 of the air box 40 by the bracket 104. The illustrated bracket 104 includes an upper bracket section 114 and a lower bracket section 116, which are separate members from one another, cooperating to support the secondary fuel injector 74. The second fuel rail 84 preferably is integrally formed with at least a portion of the bracket 104 and, more specifically, with the lower bracket section 116. Thus, a lower bracket section 116 is integrally formed with the second fuel rail 84 at each of position coinciding with one of the cylinders 30 of the engine 14. Accordingly, a total of four lower bracket sections 116 are provided in the illustrated embodiment.

An upper bracket section 114 is secured to each of the lower bracket sections 116 to support an associated fuel injector 74. Thus, in the illustrated embodiment, a total of four upper bracket sections 114 are provided to cooperate with the four lower bracket sections 116 to support the four secondary fuel injectors 74. Preferably, a pair of fasteners, such as bolts 120 (FIG. 3), secure together the each of the upper bracket sections 114 with one of the lower bracket sections 116.

Desirably, the upper bracket section 114 includes socket 122, which defines an opening sized and shaped to receive an upper end portion of the secondary fuel injector 74. The lower bracket section 116, desirably includes an annular support 124, which defines an opening sized and shaped to receive and support a lower end portion of the secondary fuel injector 74. Thus, preferably, the socket 122 and annular support 124 of the upper and lower bracket sections 114, 116, respectively, cooperate to support the secondary fuel injector 74 in a desired position relative to the intake passage 66. As described above, preferably, a spray axis of the secondary fuel injector 74 is parallel to, and, more preferably, coaxial with, an axis A of the inlet duct 64.

In the illustrated embodiment, a passage 126 is defined by the bracket 104 to permit fluid communication between the second fuel rail 84 and the secondary fuel injector 74. Thus, fuel within the second fuel rail 84 flows through the passage 126 of the bracket to the secondary fuel injector 74, where it is injected into the intake passage 66. In addition, a suitable seal member, or members, such as O-rings for example, may be provided to inhibit leakage of fuel between the second fuel rail 84 and the secondary fuel injector 74.

Preferably, a fastener, such as a bolt 106, passes through the upper wall 54 of the air box 40 and threadably engages a threaded aperture 108 defined by the bracket 104. In the illustrated embodiment, the threaded aperture 108 is defined by a mounting portion 110 of the upper bracket section 114. The mounting portion 110 defines a surface 112, which seats against an inner surface of the upper wall 54 of the air box 40. Thus, the secondary fuel injectors 74 are securely coupled to the air box 40 in a desirable position adjacent the opening 70 of the intake passage 66, which is defined by the inlet duct 64 in the illustrated arrangement. However, unlike prior arrangements, the illustrated bracket 104 reduces, if not eliminates, interruption of a flow of air into the intake passage 66.

Advantageously, the provision of the passage 126 within the bracket 104, along with integrating the second fuel rail 84 and bracket 104, reduces the total number of components of the fuel delivery system 36, which eases assembly and reduces manufacturing costs. In addition, the space occupied by the secondary fuel injector 74, the second fuel rail 84 and the associated support structure (i.e., the bracket 104) is reduced in comparison to prior known arrangements, which permits the size of the air box 40 to be kept relatively small. Accordingly, the size of the recess 44 remains relatively small, thereby increasing the capacity of the fuel tank 16.

Furthermore, because the secondary fuel injectors 74 are supported by the lid 50 of the air box 40, the secondary fuel injectors 74, the second fuel rail 84 and the bracket 104 may be easily removed as a unit along with the lid 50. The toolless coupler 96 connecting the secondary supply branch 92 to the main supply conduit 86 eases the removal of the lid 50 (and the secondary fuel injectors 74, the second fuel rail 84 and the bracket 104) from the base 46 of the air box 40.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In particular, while the present fuel delivery system has been described in the context of particularly preferred embodiments, the skilled artisan will appreciate, in view of the present disclosure, that certain advantages, features and aspects of the system may be realized in a variety of other applications, many of which have been noted above. Additionally, it is contemplated that various aspects and features of the invention described can be practiced separately, combined together, or substituted for one another, and that a variety of combination and subcombinations of the features and aspects can be made and still fall within the scope of the invention. Thus, it is intended that the scope of the present invention herein disclosed should not be limited by the particular disclosed embodiments described above, but should be determined only by a fair reading of the claims.

What is claimed is:

1. A fuel delivery system for a motorcycle including an engine having a combustion chamber, the fuel delivery system comprising a fuel injector configured to deliver a fuel charge to an intake passage communicating with the combustion chamber, the motorcycle including an air box defining a plenum chamber, an inlet duct defining at least a portion of the intake passage, the inlet duct further defining an opening of the intake passage disposed within the plenum chamber, a spray axis of the fuel injector being parallel to an axis of the inlet duct, and wherein the fuel injector is supported by the air box.

2. The fuel delivery system of claim 1, wherein the air box comprises a first member and a second member, the second member being removable from the first member, the intake passage passing through the first member and the fuel injector being supported by the second member.

3. The fuel delivery system of claim 1, wherein the fuel injector is mounted to the air box by a bracket, the bracket defining a portion of a fuel conduit supplying fuel to the fuel injector.

4. The fuel delivery system of claim 1, wherein the spray axis of the fuel injector is coaxial with the axis of the inlet duct.

5. The fuel delivery system of claim 1, wherein the fuel injector is a secondary fuel injector, and the fuel delivery system additionally comprises a primary fuel injector positioned downstream from the secondary fuel injector relative to flow of air through the intake passage.

6. The fuel delivery system of claim 1, wherein the engine of the motorcycle comprises a plurality of combustion chambers, and the fuel delivery system comprises a plurality of fuel injectors, each one of said plurality of fuel injectors being associated with one of said plurality of combustion chambers.

7. A motorcycle comprising a frame assembly, an internal combustion engine supported by the frame assembly and defining at least one combustion chamber, an air intake system configured to guide air to the internal combustion engine, and a fuel delivery system configured to deliver fuel to the internal combustion engine, the air intake system comprising an air box defining a plenum chamber, an intake passage communicating with the at least one combustion chamber, at least a portion of the intake passage defining an axis, the intake passage further defining an opening to the intake passage disposed within the plenum chamber, the fuel delivery system comprising a fuel injector configured to deliver a fuel charge to the intake passage, a spray axis of the fuel injector being parallel to the axis of the intake passage, wherein the fuel injector is supported by the air box.

8. The motorcycle of claim 7, wherein the air box comprises a first member and a second member, the second member being removable from the first member, the intake passage passing through the first member and the fuel injector being supported by the second member.

9. The motorcycle of claim 7, wherein the fuel injector is mounted to the air box by a bracket, the bracket defining a portion of a fuel conduit supplying fuel to the fuel injector.

10. The motorcycle of claim 7, wherein the spray axis of the fuel injector is coaxial with the axis of the inlet duct.

11. The motorcycle of claim 7, wherein the fuel injector is a secondary fuel injector, and the motorcycle additionally comprises a primary fuel injector positioned downstream from the secondary fuel injector relative to flow of air through the intake passage.

12. The motorcycle of claim 11, wherein the primary fuel injector is disposed outside of the air box.

13. The motorcycle of claim 7, additionally comprising a fuel tank supported by the frame assembly, wherein the air box is positioned beneath the fuel tank.

14. The motorcycle of claim 13, wherein the air box is positioned at least partially within a recess defined by a lower surface of the fuel tank.

15. A motorcycle comprising a frame assembly, an internal combustion engine supported by the frame assembly and defining at least one combustion chamber, an air intake system configured to guide air to the internal combustion engine, and a fuel delivery system configured to deliver fuel to the internal combustion engine, the air intake system comprising an air box defining a plenum chamber, an intake passage communicating with the at least one combustion chamber, the fuel delivery system comprising fuel tank, a fuel pump and a fuel injector, the fuel pump being configured to supply fuel from the fuel tank to the fuel injector through a fuel delivery conduit, the fuel injector being configured to deliver a fuel charge to the intake passage and being supported by the air box, the fuel delivery conduit comprising a first conduit section and a second conduit section extending between the fuel tank and the fuel injector, wherein the first conduit section and the second conduit section are connected to one another by a toolless coupler.

16. The motorcycle of claim 15, wherein the air box comprises a first member and a second member, the second member being removable from the first member, the intake passage passing through the first member and the fuel injector being supported by the second member.

17. The motorcycle of claim 15, wherein the first conduit section is connected to the fuel tank and the second conduit section is connected to the fuel injector.

* * * * *